US006494340B1

(12) United States Patent
Joo

(10) Patent No.: US 6,494,340 B1
(45) Date of Patent: Dec. 17, 2002

(54) TENNIS BALL CONTAINER

(76) Inventor: Young Han Joo, B1 9181, Garden Groove, CA (US) 92644

( * ) Notice: Subject to any disclaimer, the term of this patent is extended or adjusted under 35 U.S.C. 154(b) by 0 days.

(21) Appl. No.: 09/852,840

(22) Filed: May 11, 2001

(51) Int. Cl.[7] ..... B65D 6/08

(52) U.S. Cl. ..... 220/485; 220/494; 220/756; 220/763

(58) Field of Search ..... 220/485, 491, 220/494, 756, 754, 762, 763, 764, 765, 772, 773; 248/128, 130, 132, 175; 206/315.9; 294/19.2, 141, 142, 143, 167, 169

(56) References Cited

U.S. PATENT DOCUMENTS 2,835,099 A * 5/1958 Touchbery ..... 294/19.2
4,281,849 A * 8/1981 Chandick et al. ..... 280/652
4,461,504 A * 7/1984 Perez et al. ..... 248/132
5,507,541 A * 4/1996 Chen et al. ..... 280/47.371

* cited by examiner

*Primary Examiner*—Stephen Castellano

(74) *Attorney, Agent, or Firm*—Blank Rome Comisky & McCauley LLP

(57) ABSTRACT

A tennis ball container is disclosed. This container has a top barrier rod (110) having a closed rectangular profile and forming the top structure of a barrier body (100), a bottom barrier rod (120) having a closed rectangular profile and forming the bottom structure of the body. A plurality of side barrier rods (140) extend in a vertical direction between the top and bottom barrier rods to connect them into a single structure, and form two inclined opposite sidewalls of the barrier body. A plurality of elastic barrier rods (150) are vertically arranged inside the side barrier rods while being mounted to the top barrier rod at their top ends such that the rods (150) are elastically displaceable in opposite directions at their bottom portions. Two first handle rods (210) are rotatably attached to the side barrier rods at the opposite sidewalls of the barrier body. Each of the first handle rods includes a U-shaped rod part, with a linear rod part integrated with the ends of the U-shaped rod part. A second handle rod (220), having hinge shafts at its opposite ends, is hinged to each first handle rod at the hinge shafts. Two hinge brackets (400) are mounted to each first handle rod to form hinged joints of the second handle rod, and allow the second handle rod to be rotatable relative to the first handle rod while being elastically compressed.

7 Claims, 11 Drawing Sheets

TENNIS BALL CONTAINER

BACKGROUND OF THE INVENTION

1. Field of the Invention

The present invention relates to containers for tennis balls and, more particularly, to a tennis ball container with a body designed to easily load and reliably contain tennis balls, and a folding handle designed to form a variety of shapes, thus being more conveniently usable while carrying the container or practicing tennis, in addition to being easily stored within a limited space when the container is not used.

2. Description of the Prior Art

Tennis ball containers are used for containing a plurality of tennis balls to allow a user to conveniently pick up the balls while practicing tennis. That is, it is desirable for a user, practicing tennis, to continuously hit a plurality of balls without repeated pauses for gathering or picking up the balls from the ground, and so the balls are required to be contained in a container to allow the user to conveniently use the balls.

Such ball containers may be usable independently or set in a tennis-practicing machine to form a ball container part of the machine.

The tennis ball containers are necessarily designed to easily load and reliably contain tennis balls, in addition to allowing users to conveniently pick up the balls from the containers while practicing tennis. When the structure of the ball containers is designed to be usable for a variety of applications as desired, the operational function of the containers will be enhanced.

In the prior art, a tennis ball container having a body fabricated using a plurality of barrier rods has been proposed and used. This ball container has a rectangular basket structure, with barriers forming the upper, left, right and bottom walls of the structure, and may be usable independently or set in a tennis-practicing machine to form a ball container part of the machine.

When the conventional ball container is used independently without being set in a tennis-practicing machine, it is necessary for a user to feed balls into the container one by one, and so the container is inconvenient to the user. When the ball container is used as a part of a tennis-practicing machine, it is necessary to design the structure of the container to precisely agree with the machine. It is therefore impossible to change the shape of the container.

Therefore, a tennis ball container having a structure capable of being usable independently or as a part of a tennis-practicing machine has been required in the prior art.

In addition, it is preferred to design the tennis ball container such that the top opening of the container is positioned at a height allowing a user's hand to reach the interior of the container and pick up a ball without forcing the user to inconveniently bend his body while practicing tennis on the court.

SUMMARY OF THE INVENTION

Accordingly, the present invention has been made keeping in mind the above problems occurring in the prior art, and an object of the present invention is to provide a tennis ball container, in which the bottom and sidewalls of the barrier body are partially fabricated using a plurality of elastic barrier rods, with the intervals between the elastic barrier rods being elastically enlargeable to allow tennis balls to be loaded into the barrier body through the bottom of the body.

Another object of the present invention is to provide a tennis ball container, of which the handle is foldable upward and downward to be selectively usable as a handle or support legs for the barrier body, the handle thus selectively holding the barrier body at a height above the ground when it is in a fully downward folded position to allow a user's hand to reach the interior of the body and easily pick up a ball without excessively bending his body.

A further object of the present invention is to provide a tennis ball container, of which the handle consists of first and second handle rods having a folding structure, thus being overlapped together and fully laid on the top of the barrier body to form a compact volume of the container when it is desired to store the container within a limited space.

Still another object of the present invention is to provide a tennis ball container, which uses a hinge bracket designed to have a rounded edge allowing a user to easily fold the handle by simply compressing and rotating the handle relative to the bracket with less power.

In order to accomplish the above object, the present invention provides a tennis ball container, comprising: a top barrier rod bent to form a closed rectangular profile, the top barrier rod forming a top structure of a barrier body of the container; a bottom barrier rod bent to form a closed rectangular profile, the bottom barrier rod forming a bottom structure of the barrier body; a plurality of side barrier rods extending in a vertical direction between the top and bottom barrier rods to connect the top and bottom barrier rods into a single structure, and form two inclined opposite sidewalls of the barrier body; a plurality of elastic barrier rods vertically arranged inside the side barrier rods while being mounted to the top barrier rod at their top ends such that the elastic barrier rods are elastically displaceable in opposite directions at their bottom portions; two first handle rods rotatably attached to the side barrier rods at the opposite sidewalls of the barrier body, each of the first handle rods including a U-shaped rod part, with opposite ends of the U-shaped rod part bent inwardly to form two stop ends, and a linear rod part integrated with the two stop ends at its opposite ends; a second handle rod having hinge shafts at its opposite ends, and hinged to the stop ends of each of the first handle rods at the hinge shafts; two hinge brackets mounted to each of the first handle rods at positions around the stop ends to form hinged joints of the second handle rod, and allowing the second handle rod to be rotatable relative to the first handle rod while being elastically compressed.

Each of the hinge brackets surrounds the first handle rod at a position inside each stop end, the hinge bracket also having both a rod holding slit for holding the second handle rod, and a rounded edge for guiding an elastic folding action of the second handle rod relative to the first handle rod.

The two hinge brackets may be mounted to each of the first handle rods such that the rounded edges of the hinge brackets face each other or are opposite to each other.

The tennis ball container also comprises two spacer rods, each of the spacer rods having a plurality of rounded spacer portions, and mounted to the bottom barrier rod at two side surfaces of the barrier body around the bottom portions of the elastic barrier rods.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1:
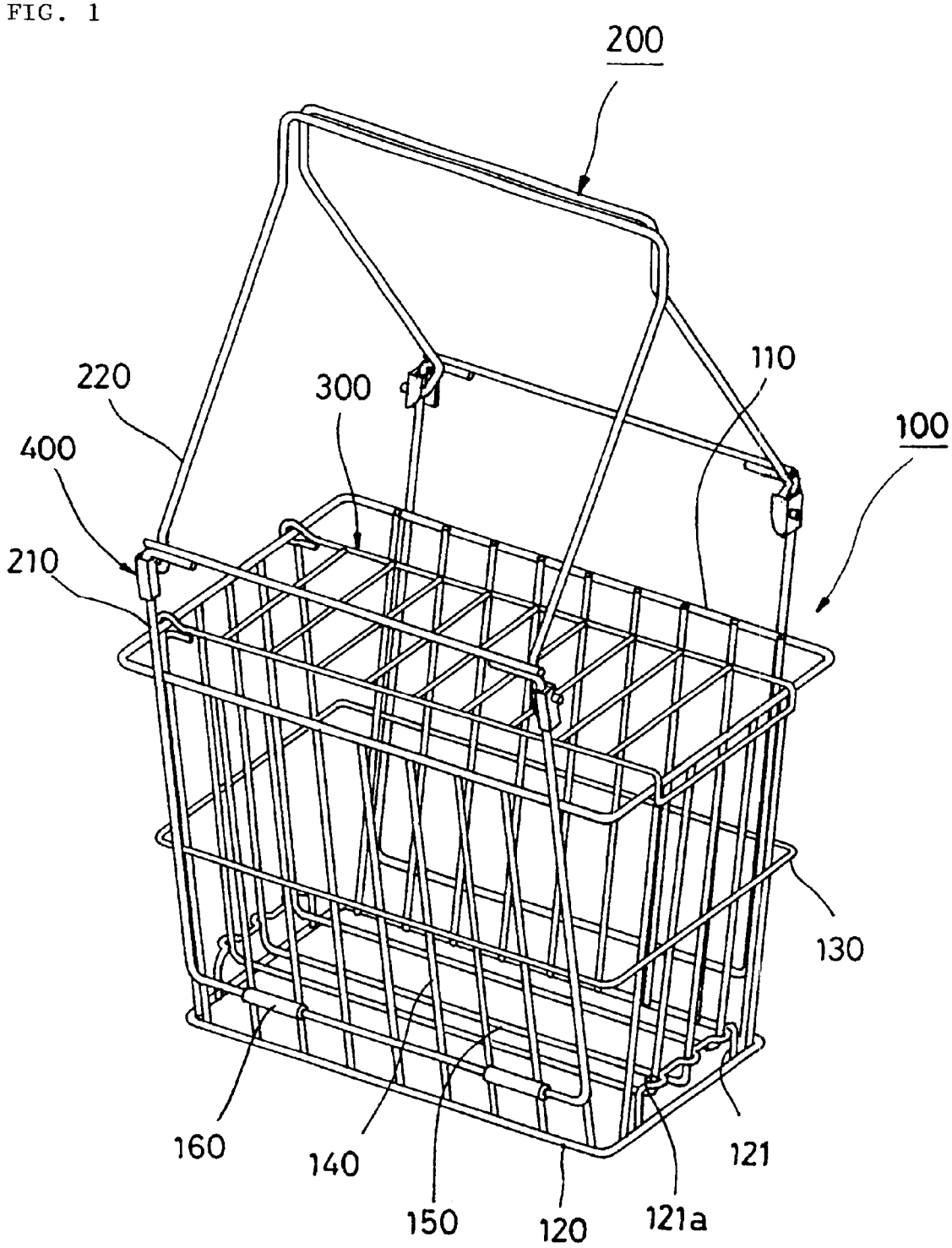
FIG. 1 is a perspective view of a tennis ball container in accordance with the present invention.

Reference now should be made to the drawings, in which the same reference numerals are used throughout the different drawings to designate the same or similar components.

FIG. 1 is a perspective view of a tennis ball container in accordance with the present invention.

As shown in the drawing, the ball container comprises a knitted barrier body 100, which is formed by knitting a plurality of barrier rods together to form a basket structure and is used for containing tennis balls. A handle 200 is rotatably attached to two opposite side surfaces of the barrier body 100 at hinged joints. The ball container also has a top cover, provided at the top opening of the barrier body 100 for preventing an undesired removal of the balls from the body 100.

The construction of the barrier body 100 will be primarily described as follows.

The barrier body 100 has a basket structure with a generally rectangular hexahedral shape. This barrier body 100 is formed by knitting a plurality of barrier rods having a predetermined diameter together to form the desired basket structure, with the intervals between the knitted barrier rods being sufficiently narrow to reliably prevent an undesired removal of the balls from the barrier body 100 through the gaps formed by the intervals.

The bottom structure of the barrier body 100 is formed by one bottom barrier rod 120, which is bent at four positions to form a rectangular profile. The four corners of the bottom structure are smoothly rounded with a predetermined radius of curvature.

The top structure of the barrier body 100 is formed by one top barrier rod 110, which has the same structure and profile as those of the bottom barrier rod 120. However, the top surface area formed by the top barrier rod 110 is larger than that of the bottom barrier rod 120.

The top and bottom barrier rods 110 and 120 are parallely and horizontally arranged at top and bottom ends of the body 100 while being spaced apart from each other by predetermined height, thus forming top and bottom edges of the body 100. The top and bottom barrier rods 110 and 120 are integrated into a single body by a plurality of side barrier rods 140, which regularly and vertically extend between the two barrier rods 110 and 120 to cover the two larger area side surfaces of the body 100. In such a case, the two larger area side surfaces of the body 100 formed by the side barrier rods 140 are inclined upward and outward since the size of top opening of the body 100 is larger than the bottom of the body 100.

One reinforcing barrier rod 130 horizontally surrounds the side barrier rods 140 at a middle portion of the body 100. This reinforcing barrier rod 130 maintains the desired intervals of the side barrier rods 140, in addition to reinforcing the structural strength and stability of the side barrier rods 140.

A plurality of elastic barrier rods 150 cover the two smaller area side surfaces of the body 100 in a manner similar to that of the side barrier rods 140. The intervals of the elastic barrier rods 150 are set to be slightly smaller than the diameter of each tennis ball.

Different from the side barrier rods 140 only covering the two larger area side surfaces of the body 100, the elastic barrier rods 150 cover the bottom surface of the body 100, in addition to covering the two smaller area surfaces of the body 100.

Figure 2:
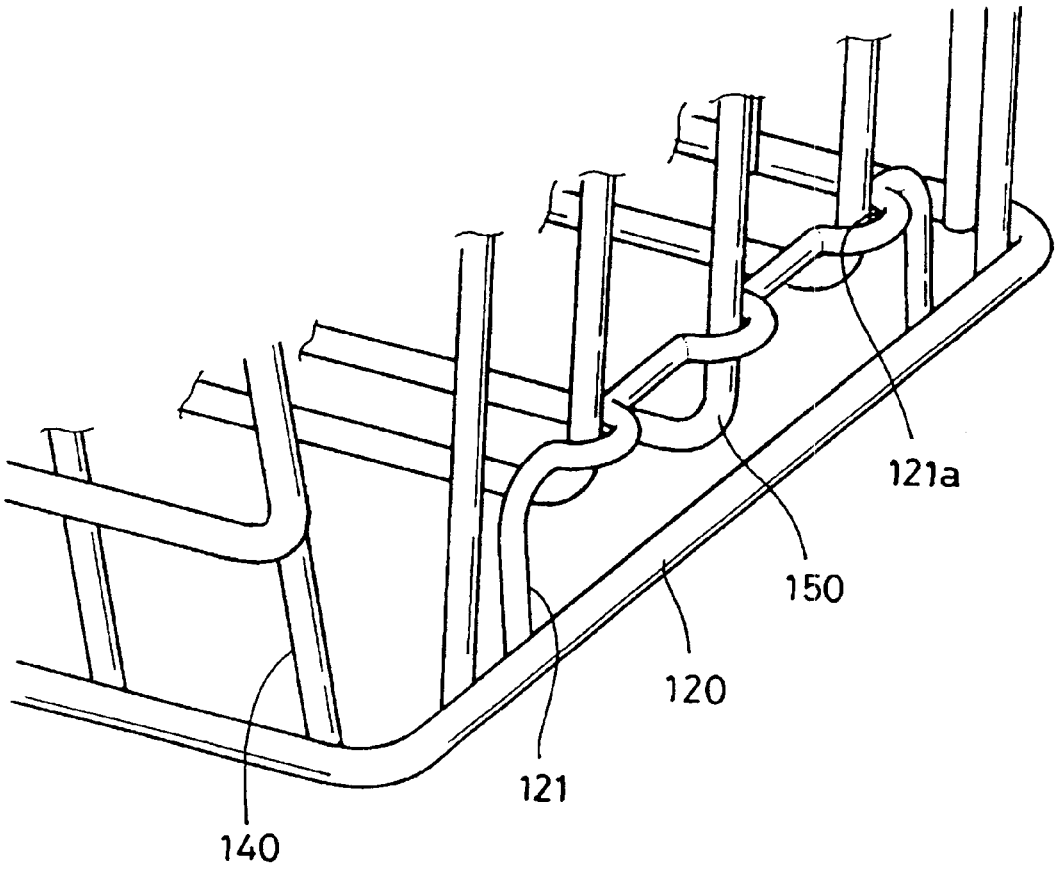
FIG. 2 is a perspective view, showing the bottom structure of the container of this invention, designed to load tennis balls into the container.
Figure 3:
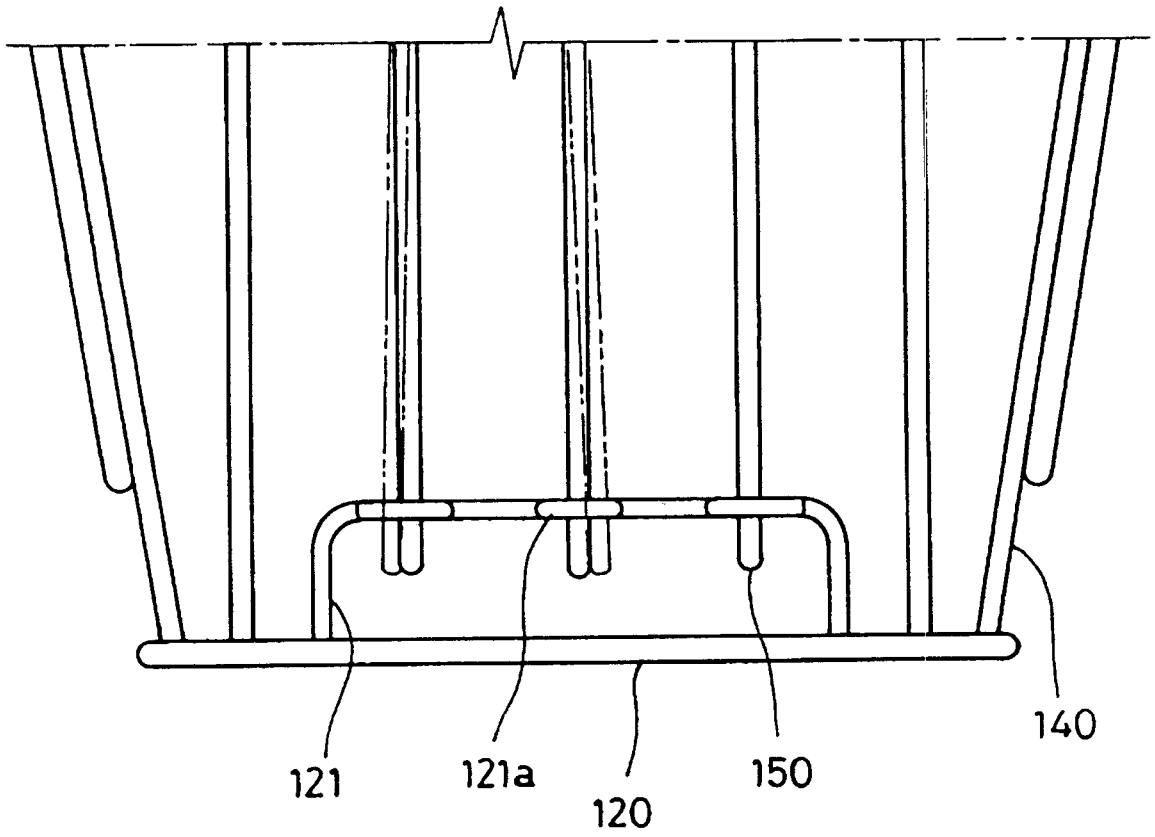
FIG. 3 is a side view, showing the bottom structure of the container in accordance with the primary embodiment of this invention.
Figure 4:
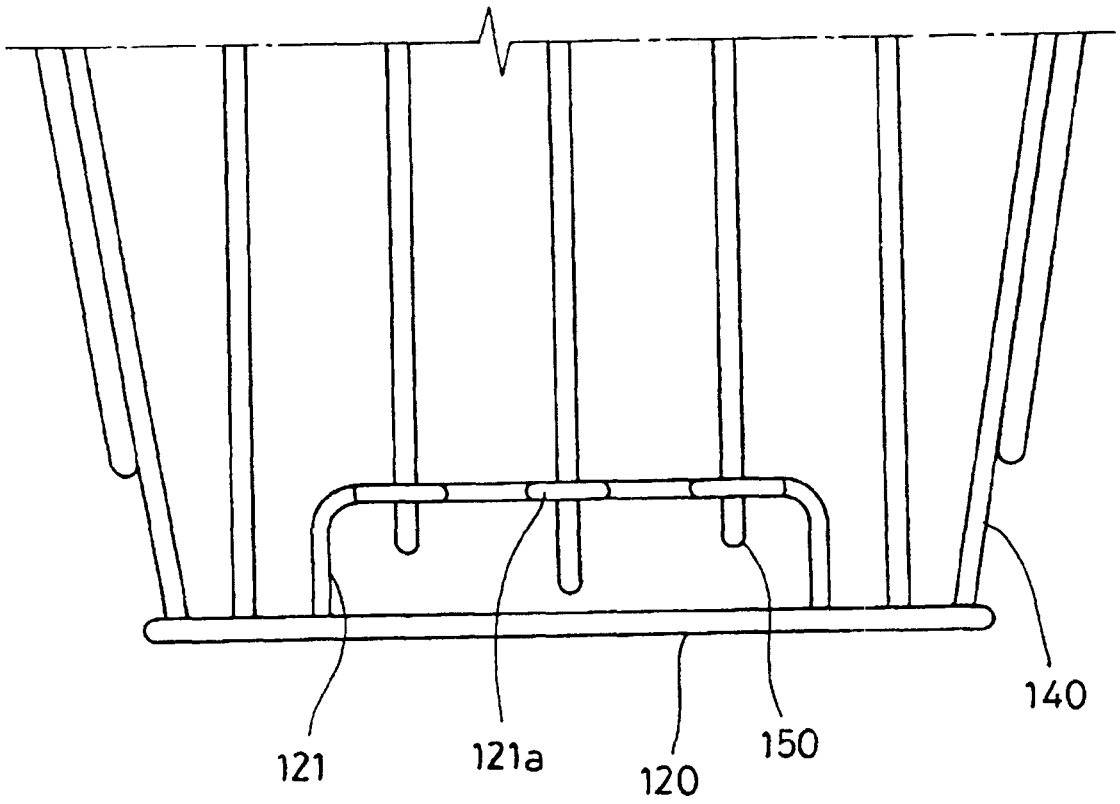
FIG. 4 is a side view, showing the bottom structure of the container in accordance with the second embodiment of this invention.

As best seen in FIG. 2, the elastic barrier rods 150, each having a U-shaped profile, are mounted to the top barrier rod 110 at their top ends such that the rods 150 are vertically positioned in the body 100 while being parallely spaced apart from each other. However, the elastic barrier rods 150 may be displaced in opposite directions at their bottom portions when they are forced. It is thus possible to change the intervals between the elastic barrier rods 150 at their bottom portions. The horizontal bottom portions of the elastic barrier rods 150 are arranged above a support surface to be spaced apart from the support surface. In such a case, the horizontal bottom portions of the elastic barrier rods 150 may be arranged at the same height from the support surface as shown in FIG. 3. Alternatively, the horizontal bottom portions of the elastic barrier rods 150 may be arranged at different heights from the support surface such that the bottom portion of the middle rod 150 is slightly lower than that of the outer rods 150 as shown in FIG. 4.

Two spacer rods 121, each having a plurality of rounded spacer portions 121*a* at predetermined positions, are vertically mounted to the bottom barrier rod 120 at the two smaller area side surfaces of the body 100. The two spacer rods 121 elastically hold the corners of the elastic barrier rods 150 to somewhat limit the elastic deformation of the intervals between the bottom portions of the elastic barrier rods 150.

Each of the elastic barrier rods 150, made of metal and having a predetermined diameter, is bent at two portions to form a desired U-shaped profile. The opposite top ends of each elastic barrier rod 150 are mounted to the top barrier rod 110 such that the elastic barrier rods 150 are integrated with the top barrier rod 110 into a single structure.

Since the elastic barrier rods 150 are mounted to the top barrier rod 110 at their top ends, but not fixed at their horizontal bottom portions as described above, the elastic barrier rods 150 may be displaced in opposite directions at their bottom portions when they are forced. Therefore, the intervals between the elastic barrier rods 150 at the bottom structure of the body 100 may be elastically deformed. It is thus possible to load tennis balls from the ground into the body 100 through the bottom of the body 100.

That is, tennis balls may be fed into the body 100 through the top opening of the body 100. However, such a feeding of balls into the body 100 through the top opening sometimes causes inconvenience to a user. That is, the bottom structure of the body 100 with the elastically deformable intervals between the elastic barrier rods 150 allows a user to load balls into the body 100 through the bottom structure in place of the top opening. When a user presses the body 100 down against a ball on the ground while standing on the ground, the interval between two elastic barrier rods 150 is elastically enlarged by pressure applied from the ball, thus allowing the ball to pass through the interval into the body 100.

The handle 200 has a folding structure with two pairs of handle rods: two first handle rods 210 and two second handle rods 220. The two first handle rods 210 are hinged to the two second handle rods 220 to form a desired folding structure of the handle 200. The two first handle rods 210 of the handle 200 are rotatably attached to the two larger area side surfaces of the barrier body 100 at hinged joints. Each of the first handle rods 210 includes a U-shaped rod part, with opposite ends of the U-shaped rod part being bent inwardly to form two stop ends. A linear rod part is integrated with the two stop ends of the U-shaped rod part at its opposite ends, thus forming a closed rectangular profile of each second handle rod 210 in cooperation with the U-shaped rod part.

Figure 5:
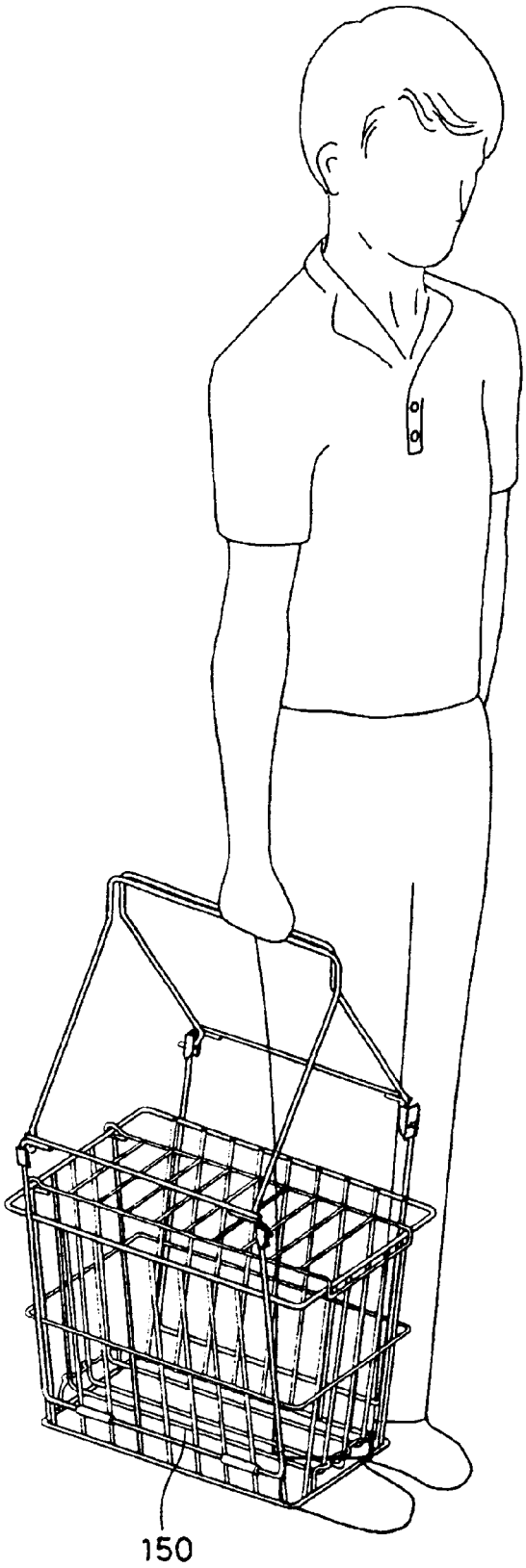
FIG. 5 is a perspective view, showing the container of this invention held by the hand of a user, standing on the ground, at the handle rods used as a handle.
Figure 10:
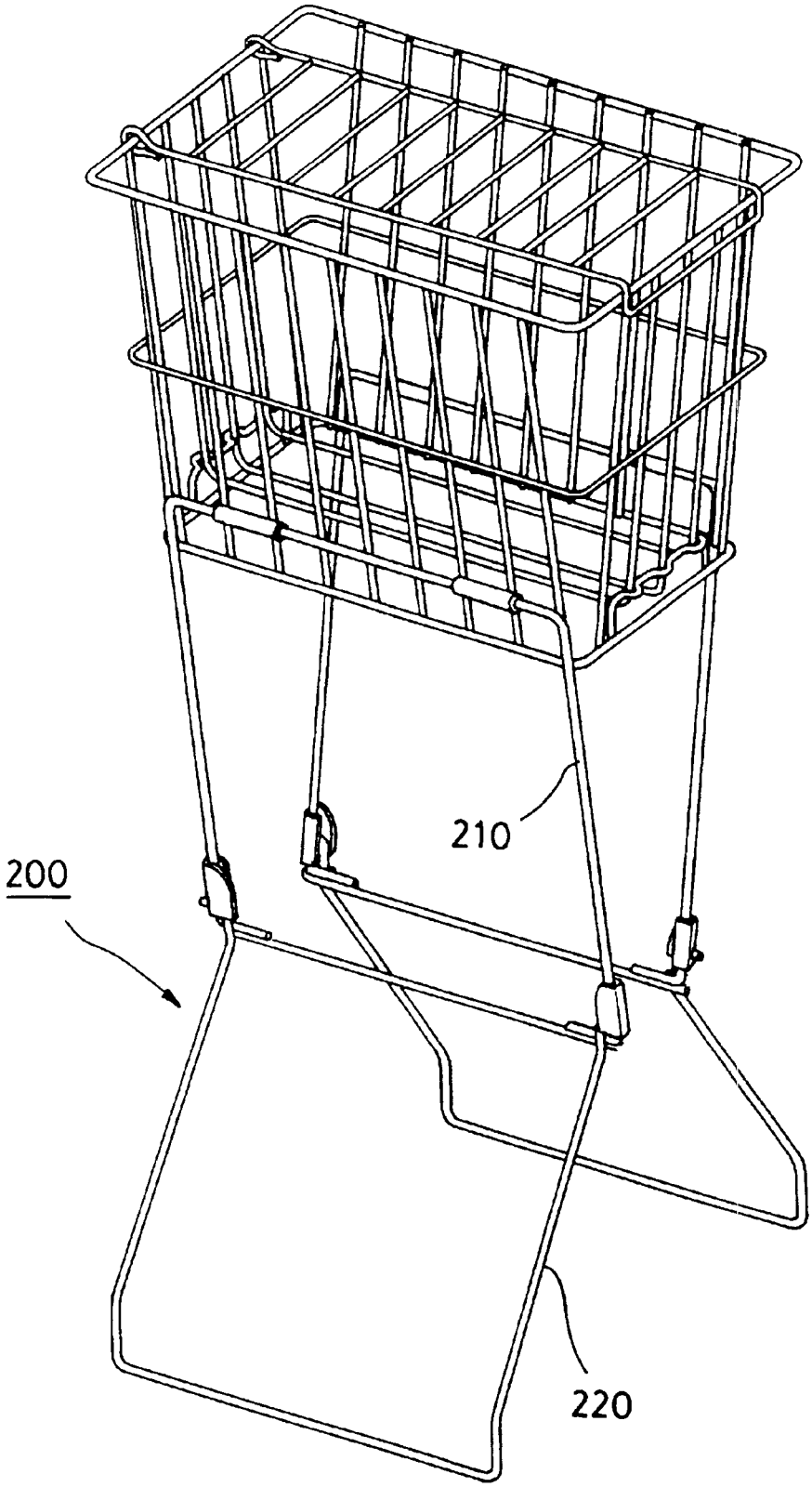
FIG. 10 is a perspective view, showing the container of this invention held at a suspended position above the ground by the handle rods used as support legs.
Figure 11:
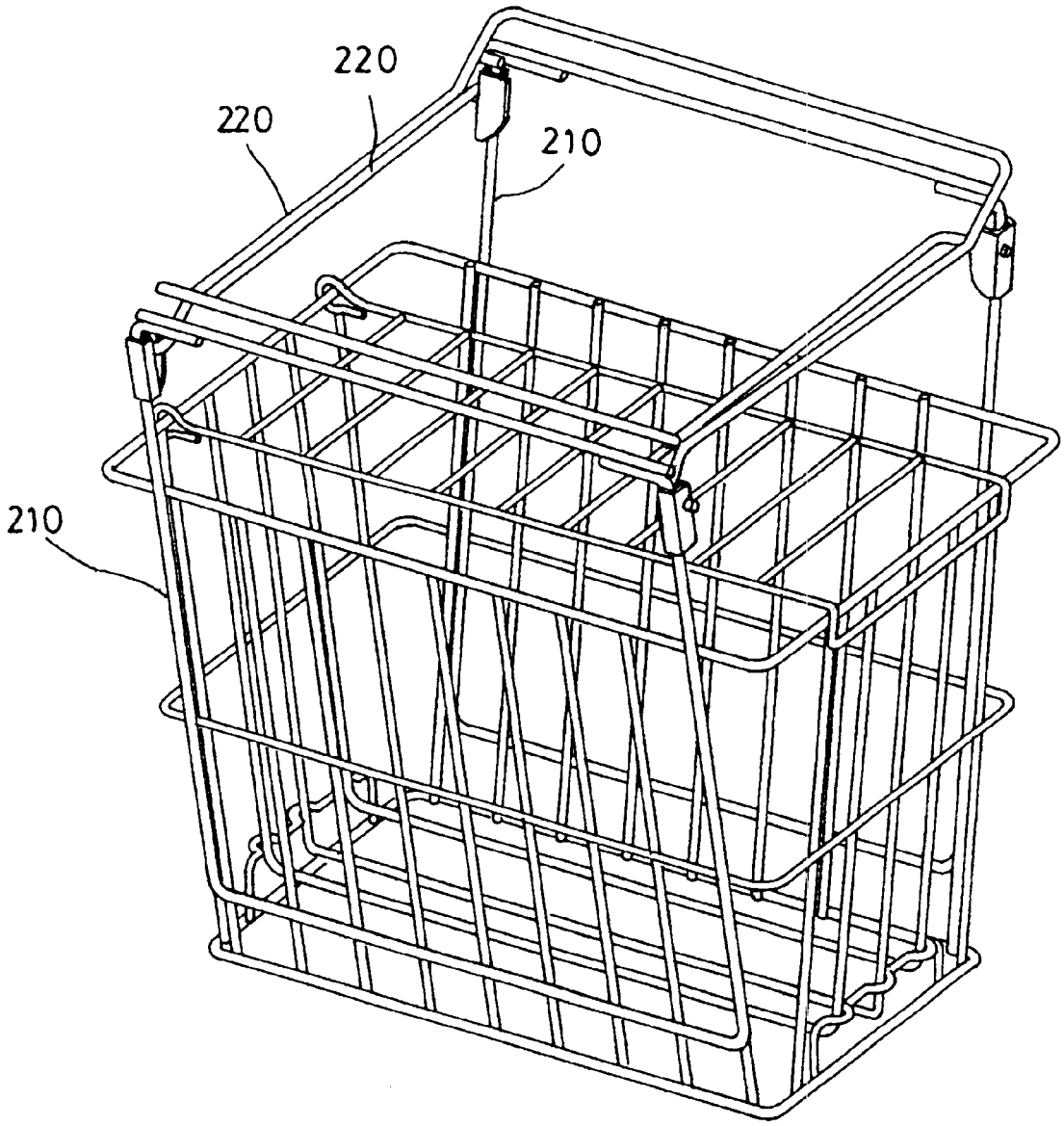
FIG. 11 is a perspective view, showing the container of this invention, with the handle rods completely folded and laid on the top of the container to accomplish a compact volume of the container.

Due to the hinged structure of the handle 200 having the handle rods 210 and 220, the handle rods 210 and 220 may be collaterally usable as support legs in a fully downward folded position of FIG. 10, in addition to being primarily usable as a handle in a fully upward folded position of FIG. 5. When the handle rods 210 and 220 form support legs as described above, the barrier body 100 is positioned above the ground such that the top opening of the body 100 is positioned at a height allowing a user's hand to reach the interior of the body 100 and pick up a ball without forcing the user to inconveniently bend his body.

In a detailed description, each of the two first handle rods 210 is hinged to two hinge bosses 160 attached to the side barrier rods 140 at each larger area side surface of the body 100. Each of the two second handle rods 220 is hinged to an associated first handle rod 210 using two hinge brackets 400.

Each of the second handle rods 220 is bent to form an inverted U-shaped profile. The opposite ends of each second handle rod 220 are bent inwardly or outwardly to form hinge shafts 222.

Figure 6:
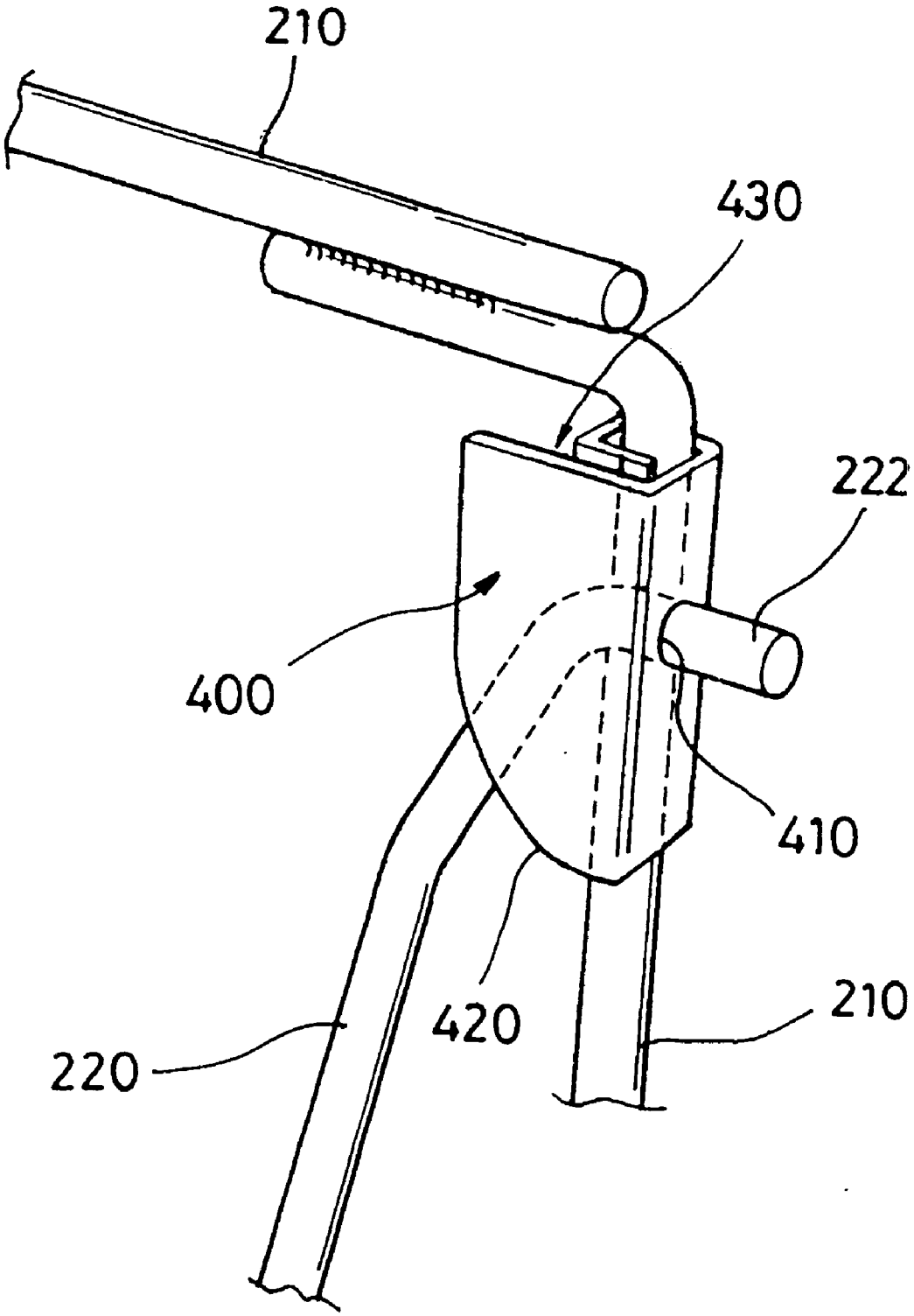
FIG. 6 is a perspective view of a hinge bracket, with first and second handle rods hinged together through the bracket to form a desired folding structure of the handle included in the container of this invention.
Figure 7:
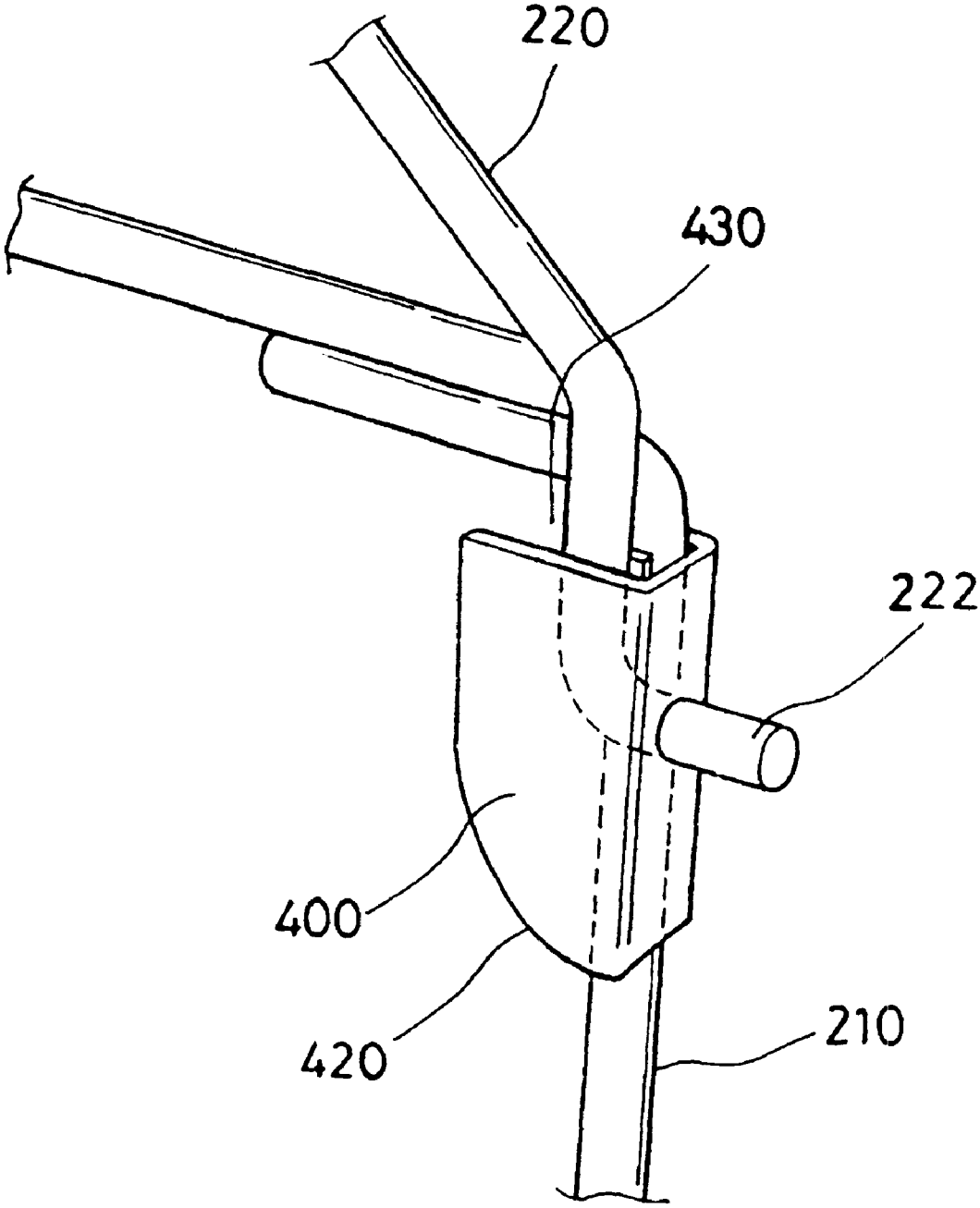
FIG. 7 is a perspective view of the hinge bracket, with the second handle rod completely and elastically seated into the rod holding slit of the bracket after it is rotated under the guide of the rounded edge of the bracket while being compressed.

As shown in FIGS. 6 and 7, each of the hinge brackets 400 is made by bending a metal plate, having a predetermined thickness, such that the bracket 400 surrounds a lower end of the first handle rod 210. Each hinge bracket 400 has both a hinge hole 410 and a rounded edge 420.

A rod holding slit 430 is vertically defined within each hinge bracket 400, and holds the end of the second handle rod 220 when the second handle rod 220 is in its fully upward folded position or fully downward folded position with the hinge shaft 222 movably fitted into the hinge hole 410.

The operational function of the hinge brackets 400 is to provide hinge joints for the hinge shafts 222 of the inverted U-shaped second handle rods 220, thus allowing a smooth folding action of the second handle rods 220. The hinge brackets 400 also allow the second handle rods 220 to be elastically and reliably seated into the rod holding slits 430 of the brackets 400 when the rods 220 move upward or downward along the rounded edges 420 while being somewhat elastically compressed. In the present invention, the hinge brackets 400 may be mounted to each of the first handle rods 210 such that the rounded edges 420 of the hinge brackets 400 face each other or are opposite to each other.

Figure 8:
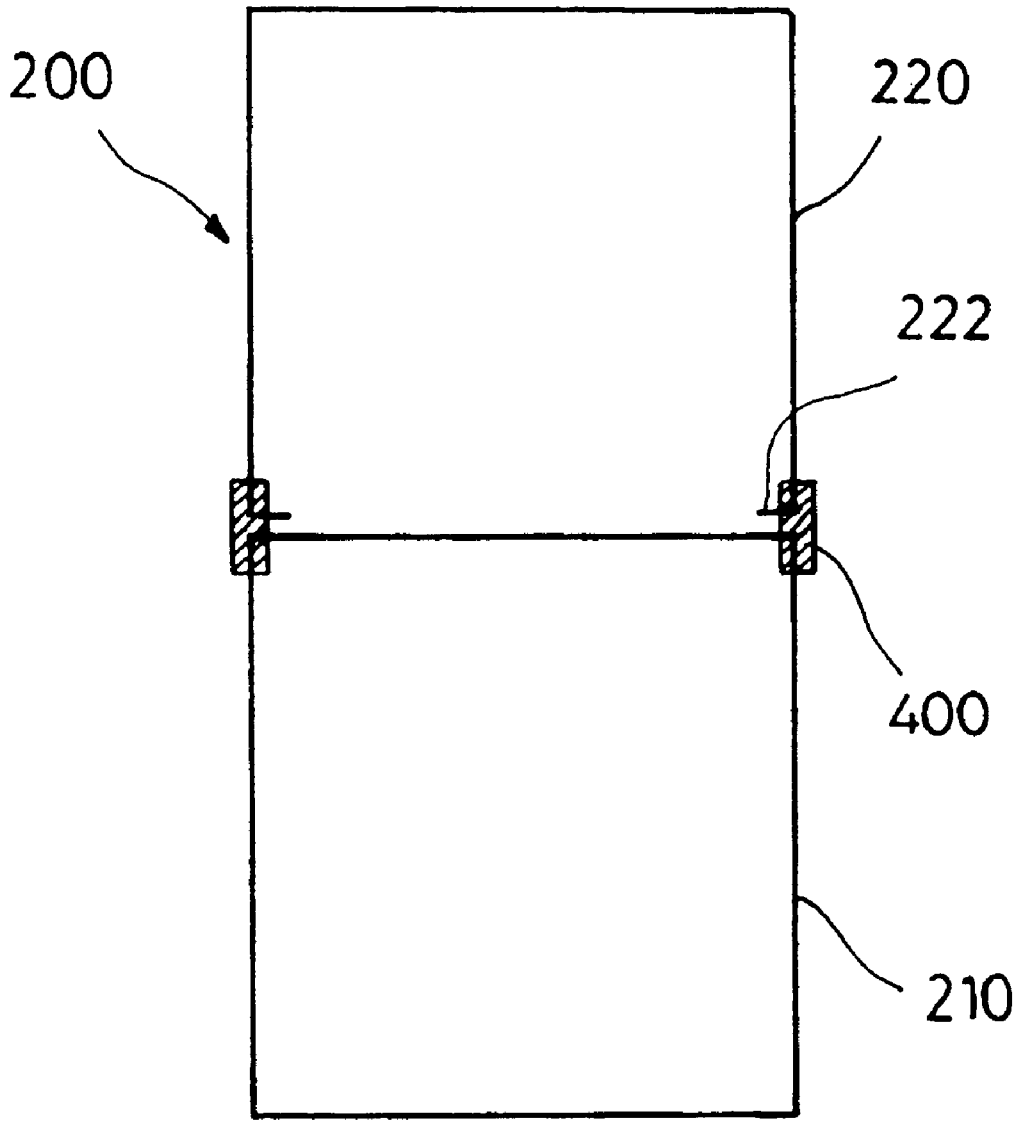
FIG. 8 is a view of a hinged engagement of the first and second handle rods through two hinge brackets in accordance with the primary embodiment of the present invention.
Figure 9:
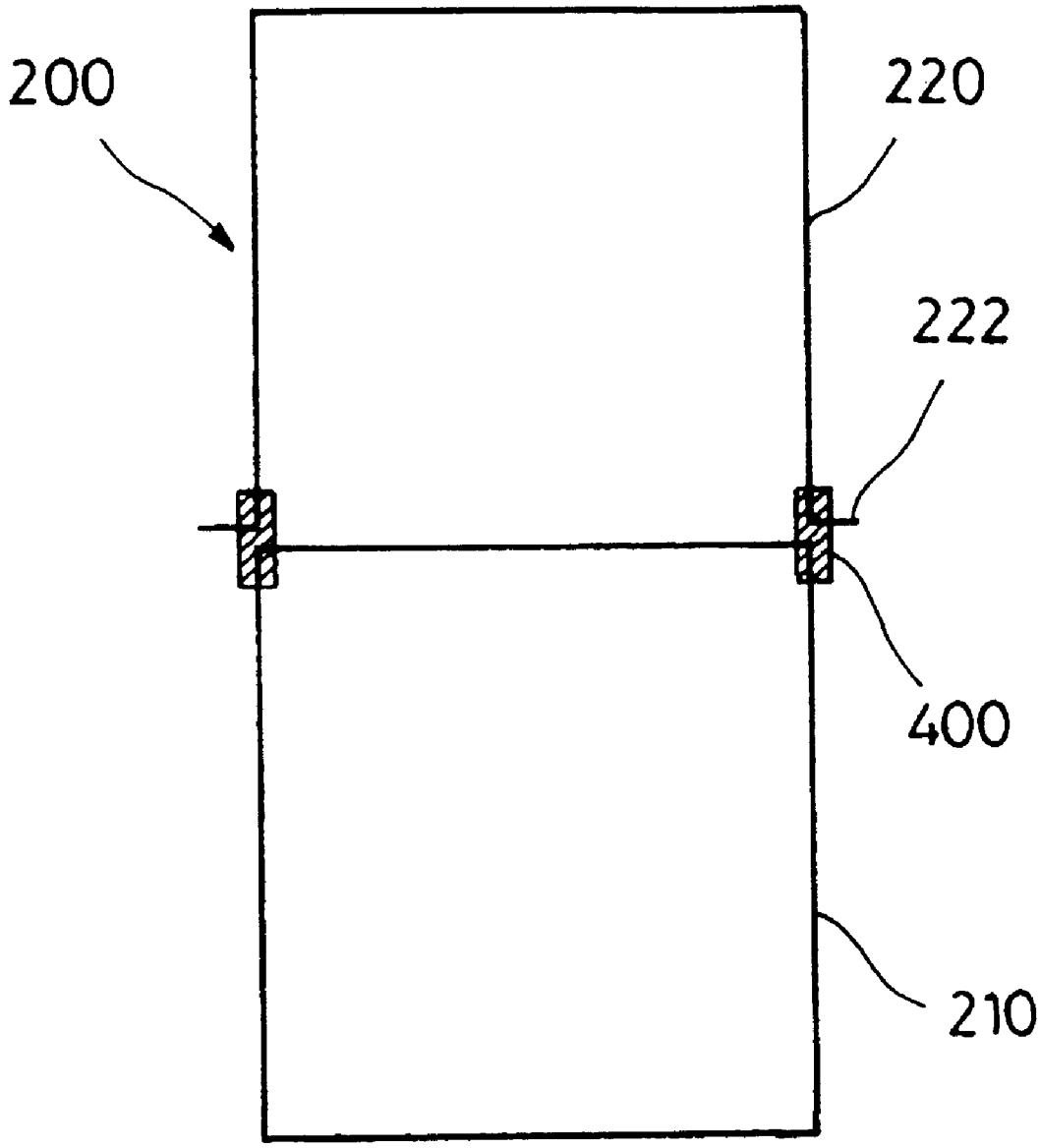
FIG. 9 is a view of a hinged engagement of the first and second handle rods through two hinge brackets in accordance with the second embodiment of the present invention.

FIGS. 8 and 9 show two embodiments of the engagement of the hinge shafts 222 of a second handle rod 220 with the hinge brackets 400.

In the embodiment of FIG. 8, the opposite ends of each second handle rod 220 are bent inwardly to form inward hinge shafts 222. In the embodiment of FIG. 9, the opposite ends of each second handle rod 220 are bent outwardly to form outward hinge shafts 222. The inward hinge shafts are more preferable than the outward hinge shafts since the outward hinge shafts are projected outwardly from the brackets 400 to undesirably injure a user.

In the tennis ball container of this invention, the two second handle rods 220 are preferably designed such that one of the two rods 220 is slightly smaller than the other in its width. It is thus possible to neatly seat one second handle rod 220 into the other, thus preventing the handle 200 from being undesirably bent, distorted or deformed due to impact, or injure the hand of a user holding the handle 200.

FIG. 10 shows the handle 200 when the two pairs of handle rods 210 and 220 are fully folded downward to form support legs for supporting the barrier body 100 on the ground.

At the fully downward folded position of the handle 200, the barrier body 100 is positioned above the ground such that the body 100 is positioned at a height allowing a user's hand to reach the interior of the body 100 and pick up a ball without forcing the user to inconveniently bend his body.

When storing the ball container of this invention in a limited space, such as the trunk of a car, the ends of the second handle rods 220 are primarily forced to accomplish their rotatable positions relative to the rod holding slits 430 of the hinge brackets 400. Thereafter, the two second handle rods 220 are rotated inward until the rods 220 are fully laid on the top edge of the barrier body 100 with the top portions of the rods 220 overlapped together.

It is thus possible to accomplish a desired compact shape of the ball container while preventing the handle 200 from forming any excessive volume, and so the container is suitable for storage in such a limited space.

As described above, the present invention provides a tennis ball container. In this container, the elastic barrier rods, forming the bottom surface of the container body having a basket structure, may be displaced in opposite directions when they are forced. Therefore, the intervals between the elastic barrier rods at the bottom structure may be elastically deformed, and allow a user to load balls into the body through the bottom structure by pressing the body down against a ball on the ground while standing on the ground. This ball container is thus convenient to the users.

The container of this invention also has a plurality of hinge brackets, which primarily provide hinge joints for the inverted U-shaped second handle rods of the handle, thus allowing a smooth folding action of the second handle rods. The hinge brackets also allow the second handle rods to be elastically and reliably seated into the rod holding slits of the brackets when the handle rods move upward or downward along the rounded edges of the brackets while being somewhat elastically compressed. It is thus possible to easily and simply fold the handle relative to the container body upward or downward with less power.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A tennis ball container, comprising:

a top barrier rod bent to form a closed rectangular profile, said top barrier rod forming a top structure of a barrier body of the container;

a bottom barrier rod bent to form a closed rectangular profile, said bottom barrier rod forming a bottom structure of the barrier body;

a plurality of side barrier rods extending in a vertical direction between the top and bottom barrier rods to connect the top and bottom barrier rods into a single structure, and form two inclined opposite sidewalls of the barrier body;

a plurality of elastic barrier rods vertically arranged inside the side barrier rods while being mounted to the top barrier rod at their top ends such that the elastic barrier rods are elastically displaceable in opposite directions at their bottom portions;

two first handle rods rotatably attached to the side barrier rods at the opposite sidewalls of the barrier body, each of the first handle rods including a U-shaped rod part, with opposite ends of the U-shaped rod part bent inwardly to form two stop ends, and a linear rod part integrated with the two stop ends at its opposite ends;

a second handle rod having hinge shafts at its opposite ends, and hinged to the stop ends of each of the first handle rods at the hinge shafts;

two hinge brackets mounted to each of the first handle rods at positions around the stop ends to form hinged joints of the second handle rod, and allowing the second handle rod to be rotatable relative to the first handle rod while being elastically compressed.

2. The tennis ball container according to claim 1, wherein each of the hinge brackets surrounds the first handle rod at a position inside each stop end, said hinge bracket also having both a rod holding slit for holding the second handle rod, and a rounded edge for guiding an elastic folding action of the second handle rod relative to the first handle rod.

3. The tennis ball container according to claim 1, wherein the two hinge brackets are mounted to each of the first handle rods, said brackets having rounded edges that face each other.

4. The tennis ball container according to claim 1, wherein the two hinge brackets are mounted to each of the first handle rods, said brackets having rounded edges that are opposite to each other.

5. The tennis ball container according to claim 1, wherein two spacer rods, each having a plurality of rounded spacer portions, are mounted to the bottom barrier rod at two side surfaces of the barrier body around the bottom portions of the elastic barrier rods.

6. The tennis ball container according to claim 2, wherein the two hinge brackets are mounted to each of the first handle rods such that the rounded edges of the hinge brackets face each other.

7. The tennis ball container according to claim 2, wherein the two hinge brackets are mounted to each of the first handle rods such that the rounded edges of the hinge brackets are opposite to each other.

* * * * *